US005078296A

United States Patent [19]

Amidzich

[11] Patent Number: 5,078,296

[45] Date of Patent: Jan. 7, 1992

[54] CONTAINER CLOSURE WITH STABLE OPEN POSITIONS

[75] Inventor: Bradford G. Amidzich, Delafield, Wis.

[73] Assignee: Kantec Manufacturing, Inc., New Berlin, Wis.

[21] Appl. No.: 520,173

[22] Filed: May 4, 1990

[51] Int. Cl.[5] ..... B65D 43/24

[52] U.S. Cl. ..... 220/335; 220/337; 220/339; 220/356

[58] Field of Search ..... 220/334, 335, 337, 339, 220/90.4, 256, 258, 259, 263, 264, 356; 215/235, 237, 238

[56] References Cited

U.S. PATENT DOCUMENTS

| | | | |
|---|---|---|---|
| Re. 30,861 | 2/1982 | Krawagna . | |
| 3,289,877 | 12/1966 | Wolf . | |
| 3,292,222 | 12/1966 | Steinberg . | |
| 3,419,181 | 12/1968 | Stec | 220/258 |
| 3,628,215 | 12/1971 | Everburg . | |
| 4,158,902 | 6/1979 | Chernack et al. . | |
| 4,403,712 | 9/1983 | Wiesinger | 220/339 |
| 4,414,705 | 11/1983 | Ostrowsky . | |
| 4,494,672 | 1/1985 | Pearson | 220/263 |
| 4,503,991 | 3/1985 | Joyce . | |
| 4,545,495 | 10/1985 | Kinsley . | |
| 4,573,600 | 3/1986 | Dubach | 215/237 |
| 4,629,097 | 12/1986 | Moore . | |
| 4,638,916 | 1/1987 | Beck et al. . | |
| 4,723,693 | 2/1988 | DeCoster . | |
| 4,726,091 | 2/1988 | Joyce . | |
| 4,778,071 | 10/1988 | Fillmore | 215/237 |
| 4,793,502 | 12/1988 | Beck | 215/235 |
| 4,805,790 | 2/1989 | Leonetti et al. . | |
| 4,813,560 | 3/1989 | Begley | 215/235 |
| 4,815,616 | 3/1989 | Silvenis . | |
| 4,852,770 | 8/1989 | Sledge et al. . | |
| 4,887,747 | 12/1989 | Ostrowsky et al. . | |

*Primary Examiner*—Stephen Marcus
*Assistant Examiner*—Stephen Cronin
*Attorney, Agent, or Firm*—Willian Brinks Olds Hofer Gilson & Lione

[57] ABSTRACT

A hinge lid for a container including a means for attaching the lid to the container. The attaching means has an exterior and an interior, the interior being proximate to the container when the attaching means is in place on the container. The hinged lid further includes a cover connected to the attaching means in a connection area. The cover has an exterior and an interior, the interior being proximate to the container when the cover is closed. A hinge is located in the connection area. The hinge includes a first rib located at the junction of the interior of the cover with the interior of the attaching means. The axis of the first rib is parallel to the axis of the hinge. The hinge also includes a second rib orthogonal to the first rib. A portion of the second rib is located on the exterior of the cover and a portion is located on the exterior of the attaching means. Another hinged lid having a hinge comprising a recess in the attaching means and a foot connected to and actuated by the cover so that it travels in the recess. A bump in the recess interferes with the travel of the foot, and stable positions of the cover are determined by the location of the foot on either side of the bump. The cover of both hinged lids may also be directly attached to the container, in which case a separate attaching means is not required.

14 Claims, 4 Drawing Sheets

CONTAINER CLOSURE WITH STABLE OPEN POSITIONS

BACKGROUND OF THE INVENTION

The present invention relates to a hinge for a container lid and more particularly to a container closure for beverage cans which has stable open positions.

Carbonated beverages and the like which are commonly sold in single serving 12 ounce aluminum cans, are not usually provided with resealable lids. Such cans usually have a tab or lever-type member which is used to pry open a hole in the top of the can so that the beverage can be consumed directly out of can or poured into another container. When a beverage in such a can is consumed outdoors, the beverage can attract bees, wasps or other insects that are not only a nuisance, but may pose a health hazard as well. In fact, because cans of the type described are opaque and the opening in the top is relatively small, a bee, wasp, or other insect can enter the can after it has been opened without the person consuming the beverage being aware of it. There have been instances in which persons have been stung by a bee that entered a beverage can in this manner. Therefore there is a need for a resealable lid for such cans.

Aside from beverage containers of the type described above, various containers for other consumer goods are provided with resealable lids. These include foods, cosmetics, household supplies, etc. Many of these resealable lids include hinges of the unitary type, i.e., molded of a single plastic piece with the container or with a cap that can be threaded onto the container. Depending on the contents of the container and the manner in which the contents are to be dispensed, these containers will have differing requirements for lid and hinge arrangements and, in particular, for the manner in which the lid of the container is opened and closed. For example, for some containers, the contents will be sipped, e.g. beverages. Other containers are used for materials that are normally poured. Still other containers are used for materials that are sprinkled. It follows therefore that, depending on the type of material and how it is used, there are different functional requirements for both the container and the lid. For example, this includes specific functional requirements as to the angle that the lid remains open and the number of stable open positions of the container lid.

To this end, there are various types of hinges for containers that provide to some extent for stable open lid positions. Theses hinges have in general only provided for one stable open position or have other operating or design characteristics that limit their usefulness, e.g. they snap shut too fast or have a post extending out from the hinge which may complicate packaging of the container.

Underlying the present invention is the need for a hinge for a container lid in which one or more stable open positions or ranges of stable open positions can be established. Further, these stable open positions should be freely selectable unencumbered by requirements associated with pivoting posts. Moreover, the hinge should also not protrude significantly from the body of the container, to facilitate storage and packaging. In addition, the hinge should be simple to construct and inexpensive to produce.

SUMMARY OF THE INVENTION

According to a first aspect of the present invention, there is provided a hinged lid for a container having a means for attaching the lid to the container. The attaching means has an exterior and an interior, the interior being proximate to the container when the attaching means is in place on the container. The hinged lid further includes a cover connected to the attaching means in a connection area. The cover also has an exterior and an interior, the interior being proximate to the container when the cover is closed. A hinge is located in the connection area; the hinge comprises a first rib and a second rib. The first rib is located at the junction of the interior of the cover with the interior of the attaching means, and the axis of the rib is approximately parallel to the axis of the hinge. The second rib is orthogonal to the first rib, and a portion of the second rib is located on the exterior of the cover and a portion is located on the exterior of the attaching means. The invention also provides methods of making this hinged lid.

Suitable attaching means include: a collar for frictionally engaging the container, with or without friction-enhancing means; or a threaded sleeve that can be screwed onto the container. Such collars or sleeves may engage all or only part of the periphery of the container. Attaching means may similarly include fingers, clamps, or other structures to cooperate with at least a portion of the container. Other suitable attaching means will be known to those skilled in the art. The cover may also be directly connected to the container, in which case a separate attaching means is not needed.

In another embodiment of the present invention, the hinge comprises a recess in the attaching means and a foot connected to and actuated by the cover so that the foot travels in the recess. In the recess, one or more bumps are positioned in the path of travel of the foot. The bumps interfere with the travel of the foot, and stable positions of the cover are determined by the location of the foot with respect to the bumps.

Suitable attaching means are as described above. Also, as above, the cover may be connected directly to the container, in which case the recess is located in the container.

DETAILED DESCRIPTION OF THE PRESENTLY PREFERRED EMBODIMENTS

Figure 1:
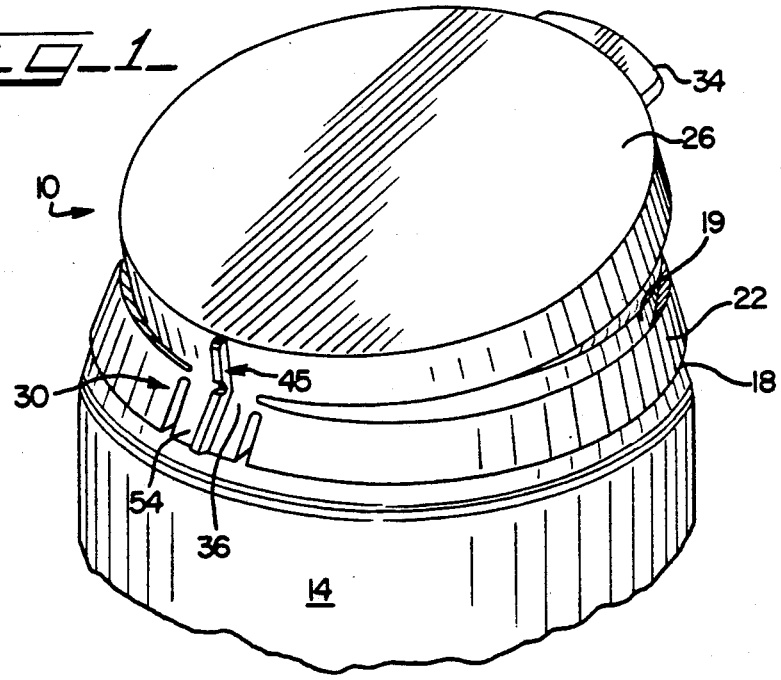
FIG. 1 is a perspective view of a first preferred embodiment of the present invention.

Referring to FIG. 1 there is shown a first preferred embodiment of the present invention. A hinged lid 10 is used in conjunction with a container 14. Preferably, the entire hinged lid and all of its component parts are formed as a result of a single molding operation which produces a single molded piece with an integral hinge. This has the advantage of reducing the handling and construction expenses associated with assembly of separate pieces. However, some of all of the parts may be formed separately and joined together by an adhesive or by fusing or by other means. In the illustrated embodiment, the hinge 30 is of an integral type, i.e. it is formed of the same molded plastic piece as the rest of the lid.

The hinged lid and its parts are made of polypropylene or other materials having similar properties.

In the embodiment shown in FIG. 1, the container 14 is a typical cylindrically-shaped beverage container which may be made of aluminum or other metal, glass, or even plastic. Containers of this type typically include a recessed region or groove 18 proximate the dispensing end of the container. Such a groove may be formed, for example., by the joining operation that attaches the top of a container to the body of the container, or may be otherwise formed. Although described for use in conjunction with a container having a recessed groove at the end thereof, the present invention may also be used with containers not having this groove or with containers having other shapes.

In FIG. 1, the hinqed lid 10 includes a collar 22 adapted to fit into the recessed groove 18 of the container 14 to attach and secure the hinged lid 10 thereto. The collar 22 may be dimensioned for use with the desired size container, or may be adjustable or otherwise adapted to cooperate with containers of various sizes.

The hinged lid 10 also includes a cover 26 which is attached to the collar 22 by the hinge 30 in a pivoting relationship. In the preferred embodiment, the cover 26 and collar 22 are formed of a single piece of plastic and are connected to each other. The cover 26 is sized to engage the rim 19 of the container so that the top of the container is sealed off from the environment and insects and debris cannot get into the container. The cover may otherwise be adapted to engage the rim 19, the collar 22, or both, to seal off the container. In the preferred embodiment, a sealing gasket 21 is formed on the inner surface of cover 26 to engage rim 19, sealing the top of the container and holding the cover closed. A tab 34 is provided on the cover 26 to facilitate opening and closing of the cover.

Figure 2:
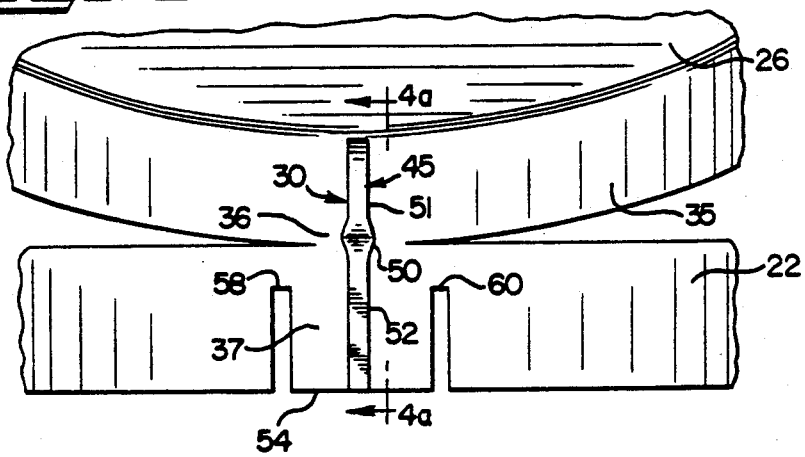
FIG. 2 is a another view of the embodiment of FIG. 1.

FIG. 2 shows a plan view of the hinge 30. The hinge connects the collar 22 to the cover 26 at connection area 36. This connection may be accomplished during the manufacture of the lid by either molding the collar and cover as a single piece, or by molding the collar and the cover as separate pieces and then connecting them together. Connection may be made by an adhesive, by fusing, or by other known means.

Figure 3:
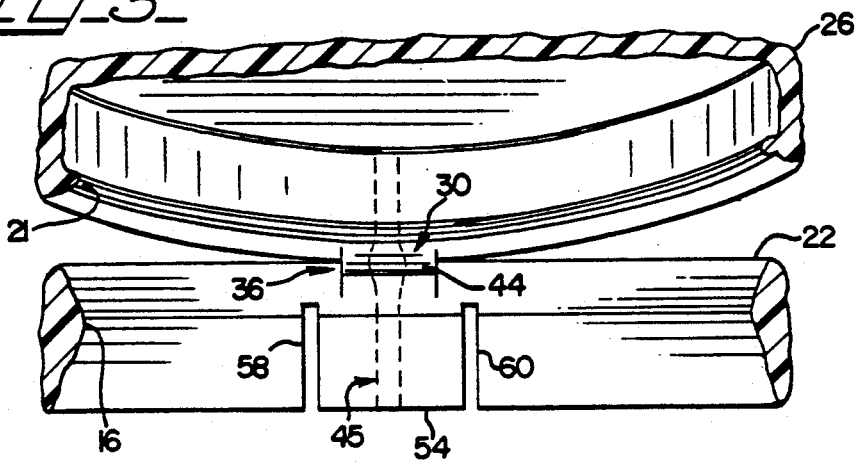
FIG. 3 is a another view of the embodiment of FIG. 1 from the inside thereof.

FIG. 3 is an inside view of the hinge 30. A first rib 44 is located at the junction of the interior of the cover 26 with the interior of the collar 22 at the area of connection 36. The first rib 44 has an axis which is approximately parallel to the axis of the hinge 30. The first rib 44 preferably is formed during the molding process of the lid 10 and is part of a single molded plastic piece. The first rib 44 extends a small distance horizontally in both directions from the area where it is adjacent to a second rib 45, which is described below.

Referring again to FIG. 2, the hinge 30 includes a second rib 45 located exterior of the connection area 36. The second rib 45 is preferably formed of the same molded plastic as the collar 22 and cover 26. The second rib 45 is orthogonal to the first rib 44 and includes a portion 51 which extends at least part way across the exterior side 35 of cover 26 and a portion 52 which extends at least part way across the exterior side 37 of collar 22.

Figure 4A:
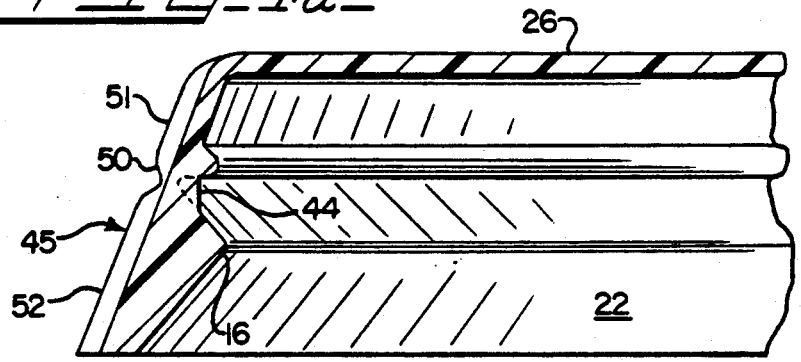
FIG. 4*a* is a sectional view of the embodiment of FIG. 1 taken along line 4*a*–4*a* of FIG. 2.

FIG. 4*a* is a vertical section of the hinge 30 taken along line 4*a* of FIG. 2. As shown, the first and second ribs 44, 45 are directly adjacent to each other in the area of connection 36 between the cover 26 and the collar 22.

The relative depth dimensions of the first and second ribs help define the stable open positions of cover 26 as well as assist in establishing biasing of the cover 26 associated with hinge 30. In order to provide a lid having operating characteristics suitable for a beverage container, the first rib 44 is constructed having at least approximately twice the depth dimension of second rib 45, i.e. the depth dimension of the second rib 45 is d and the depth dimension of the first rib 44 is approximately at least 2*d*. In a preferred embodiment, the depth dimension d of the second rib 45 is 1/32 inches and the depth dimension of the first rib 44 is 1/16 inches.

Figure 4B:
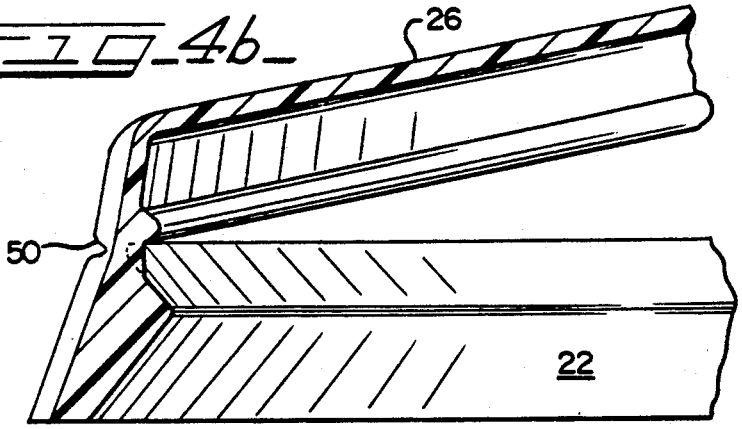
FIG. 4*b* is a view as in FIG. 4*a* showing the lid in a first open position.

In one or more operations of opening the lid, i.e. bending the cover 26 away from the collar section 22, a collapse of deformation of the second rib 45 occurs causing a dimple 50 to form in the second rib 45 in an area thereof adjacent to the first rib 44. This dimple 50 remains in the second rib even after the cover 26 is closed, as shown in FIG. 4*b*. Thereafter, during operation of the lid, the hinge has a range of stable open positions determined by the dimensions of the first and second ribs 44, 45 and the dimple 50.

Figure 4C:
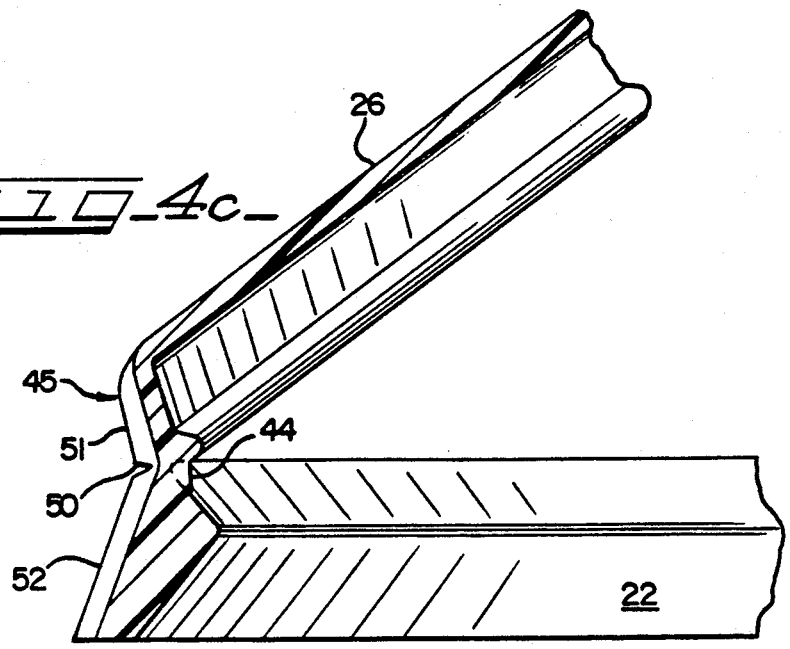
FIG. 4*c* is a view as in FIG. 4*a* showing the lid in yet another open position.

The first stable open position is at the point where the cover 26 is closely proximate to the container rim as depicted in FIG. 4*b*. This first stable open position forms a low angle relative to the top of the container. From the first stable open position, a range of stable open positions exists to the point at which the portions 51, 52 of the second rib 45 on either side of dimple 50 come together, or nearly come together, as depicted in FIG. 4*c*. After this point, the upper and lower portions 51, 52 of the second rib 45 push against each other, either directly or by balancing of the elastic forces around the dimple 50, and any further movement of the cover toward a further open position is resisted by the elastic forces of the second rib portions 51, 52 in compression and will result in a biasing the cover back toward the range of stable open positions. Unless this force transfers to another member, as explained below with respect to a further aspect of the present invention, positions beyond this point are not stable so that the cover will return to a stable position after release of the force applied thereto. Accordingly, the hinge 30 provides for both establishing a range of stable open positions and also for biasing the cover outside the stable range defined by the dimple.

The cover biasing function may be put to advantage in other embodiments of the invention in which a different range of stable open positions is desired. For example, if it is desired to have a range of stable open positions that does not begin immediately after the cover is opened, i.e., at an small angle away from the closed position, the lid may be molded with the cover in the desired position that approximates the beginning of the range of stable open positions. Then, when the cover is opened it will spring to the position approximately at which it was molded. Again, further opening of the cover will cause the second rib to collapse to form a dimple, defining a range of stable open positions. As before, when the cover is opened until the dimple is completely compressed, or nearly so, action of the hinge will operate in the opposite direction to move the cover back toward the range of stable positions. Thus, the range of stable open positions defined by the dimple can be established to begin and end at different angles depending on the desired operating characteristic.

In a further aspect of this invention, the size of the range of stable open positions may be selected. The size of the range is established by the dimensions of the second rib 45. Where a small range is required, the second rib 45 is made relatively narrower, thus providing a smaller dimple 50. The smaller dimple permits a relatively smaller range of stable positions.

Further, the size of the dimple may be reduced to zero. This may be accomplished by constructing the second rib 45 with a depth that is more than half the depth of the first rib 44. With the first and second ribs having relative proportions in this range, a hinge 30 can be provided in which a dimple will not form in the second rib 45. Without the dimple, the biasing action of the hinge will operate at all times whenever the cover is moved from the position at which it was molded. Thus, if the cover were molded in a 'closed' position, the hinge would tend to bias the lid toward a closed position. Thus, a sinqle stable closed position is provided.

As applied to the problem of the open beverage cans, described above, the hinged lid 10 readily can be attached to the beverage can either before or after the can is opened. The collar 22 is fitted around the end of the can and retained in place thereon by its elasticity. Retention may be aided by providing ridge 16 (shown in FIG. 4*a*) to cooperate within groove 18 of the container.

Between sips of the beverage, the cover 26 may be snapped shut to prevent insects from entering the can. In the preferred embodiment, integral gasket 21 (shown in FIG. 3) engages container rim 19 and releasably secures the cover in the closed position. Alternatively, the cover may seal to the collar, and alternative known means (not shown) may be provided to releasably hold cover 26 in a closed position, such as snaps or detents. When the top of the can is enclosed and sealed in this manner, the scent of the beverage is reduced thereby making it less attractive to insects. The cover may easily be snapped open to allow consumption of the beverage. In one preferred embodiment, the hinged lid is removable from the can so that it can be attached to another can. In another embodiment, the lid may be permanently attached to the can and provided therewith as part of the product.

According to a further aspect of the present invention, hinges having an additional range of stable positions may be provided. These stable open positions are beyond those provided by the interaction of the first and second ribs described above. Referring again to FIG. 2, the hinge 30 may further include a foot 54 associated with the second rib 45. The foot 54 is actuated by the lower portion 52 of the second rib 45. In a first preferred embodiment, a foot 54 is formed of a portion of the collar 22 by slits 58 and 60. These slits allow for independent movement of the foot 54 and the collar 22.

When the cover 26 is opened to a point where the dimple 50 is fully or nearly fully collapsed or compressed, such as represented in FIG. 4*c*, further opening of the cover can no longer be accommodated by the dimple and the forces are transferred to foot 54 causing foot 54 to pivot so that it bears against the recessed groove 18 of the container 14. The end of the foot 54 travels in the curved path defined by the recessed groove 18 of the container 14 until it finds a stable position, which in this embodiment occurs where foot 54 is directly against the rim 19 of the container.

The degree to which the foot can move, or the manner in which it moves in the groove 18 of the container 14, are determined by the size of foot 54 and the size of groove 18, as well as by the resiliency associated with the stretching of collar 22, and the resiliency associated with container 14 (e.g. an aluminum can), and by deformation of the foot. In this manner, additional stable open positions of the cover 26 can be provided beyond the range of stable open positions provided by the first and second ribs and dimple in the absence of the foot 54.

Thus, by selection of different sizes for the first rib, the second rib, the dimple, the foot, and the recessed groove, numerous stable positions can be provided, as well as ranges of unstable positions in which the hinge biases the lid from an unstable position or range of positions to a stable position or range of positions.

In further aspects of this invention, the second rib need not be positioned exterior to the surface of the collar and cover. Instead, the second rib can be coincident or coplanar with the surface of the collar or cover, or both. Similarly the first rib can be formed coincident or coplanar with the collar or cover, or both.

Figure 5:
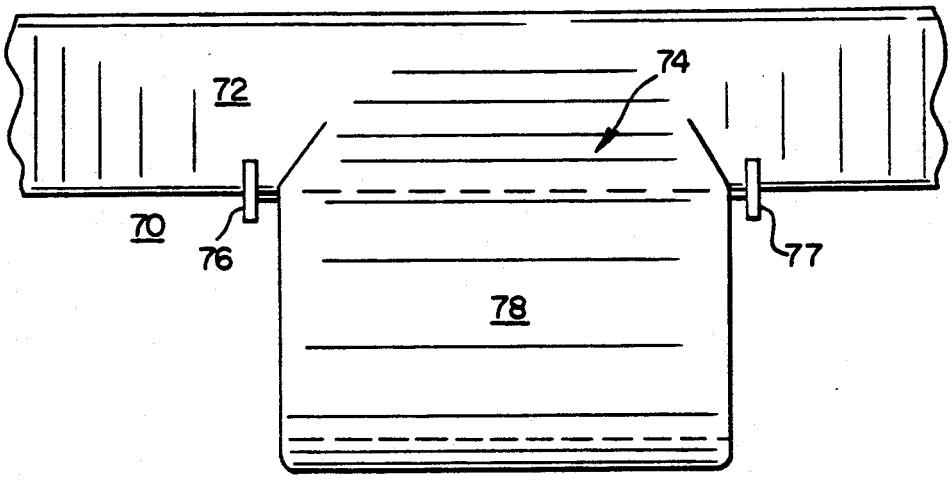
FIG. 5 is a view of another preferred embodiment of the present invention.

Another embodiment of the invention is depicted in FIG. 5. In FIG. 5, the hinge 74 is integrated into a container 70 instead of attached to a container by means of a separate collar. The hinge is directly associated with both the container 70 and cover 72.

More specifically, the container 70 has a cover 72 connected to the container by hinge 74. The hinge 74 includes connection members 76 and 77. Connection members 76 and 77 may include first and second ribs for providing a range of stable positions and for biasing the cover, as described above. In addition, this embodiment includes a foot 78 connected to and actuated by the cover and associated with the connection members 76 and 77. The foot 78 serves the same function as the foot described above insofar .as the foot 78 enables a selection of a range of stable open positions for the cover.

Figure 6:
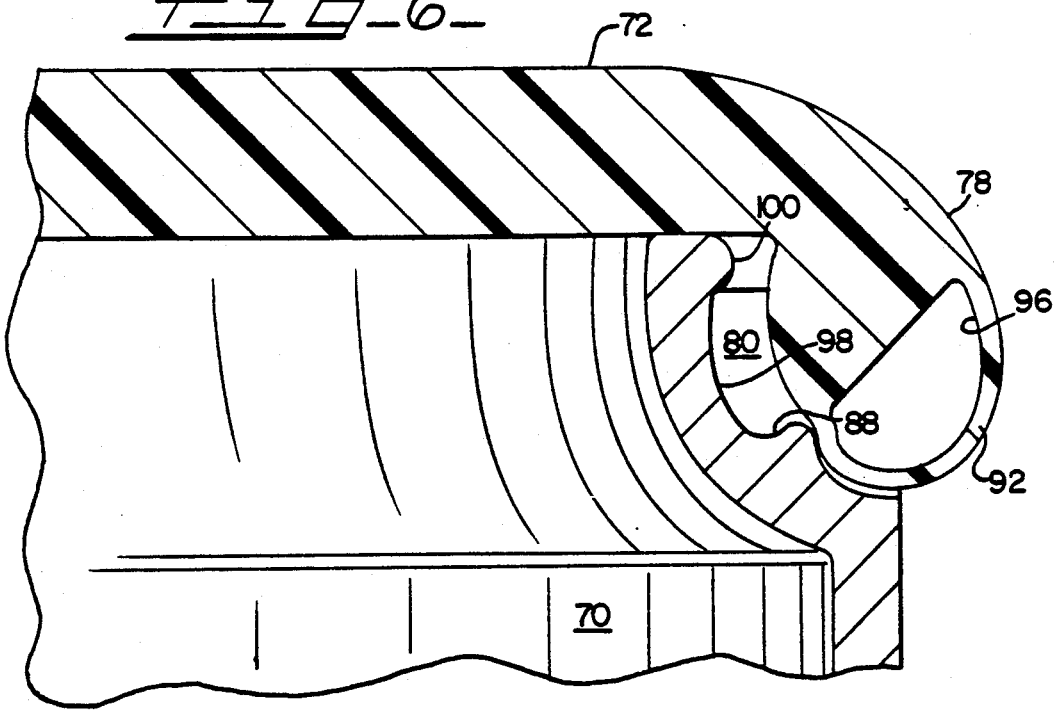
FIG. 6 is a vertical sectional view of the embodiment of FIG. 5.
Figure 9:
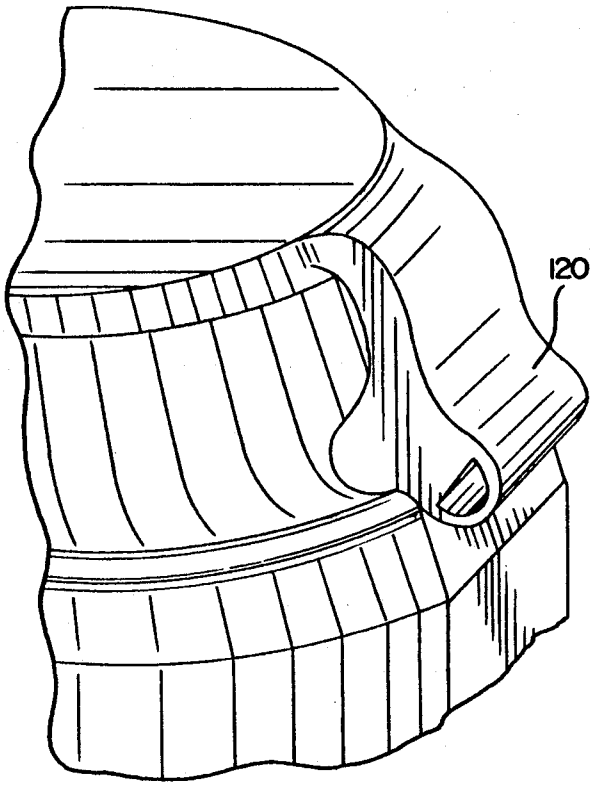
FIG. 9 is a perspective view of the embodiment depicted in FIG. 8.

Referring to FIG. 6, which is a vertical sectional view of the embodiment depicted in FIG. 5, the foot 78 moves in a recess 80 formed in the container 70. The recess 80 includes one or more interference bumps 88 along the path of travel of the foot 78. As shown in FIG. 6, the foot 78 will preferably comprise a wall 92 having a hollow core 96. This hollow core 96 makes the foot 78 deformable so that when application of force to the cover 72 causes foot 78 to contact the bump 88 in the recess 80 of the container 70, the foot 78 can be deformed and traverse the bump 88. After traversing the bump 88, the foot 78 regains its undeformed shape and will remain at position 98 on the far side of the bump 88. The bump 88 is sized to prevent cover 72 from returning to a closed position until such time as forces applied to the cover in the opposite direction cause foot 78 to deform and traverse bump 88 again.

One or more bumps 88 may be provided to provide stable positions along the path of travel of the foot 78. In addition, the absence of bumps 88 or equivalent structures would result in no stable open positions in this range. An end bump 100 may be provided to prevent opening the cover too far and to provide a well-defined terminus for the available range of positions.

Figure 7:
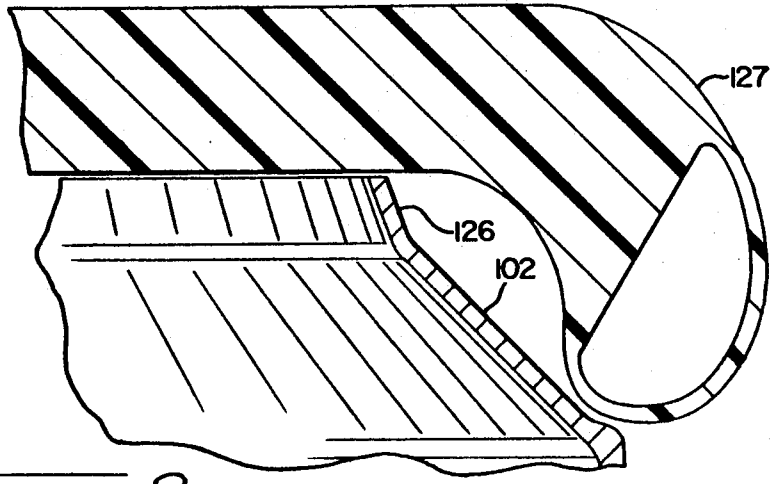
FIG. 7 is a vertical sectional view of another embodiment of the present invention.
Figure 8:
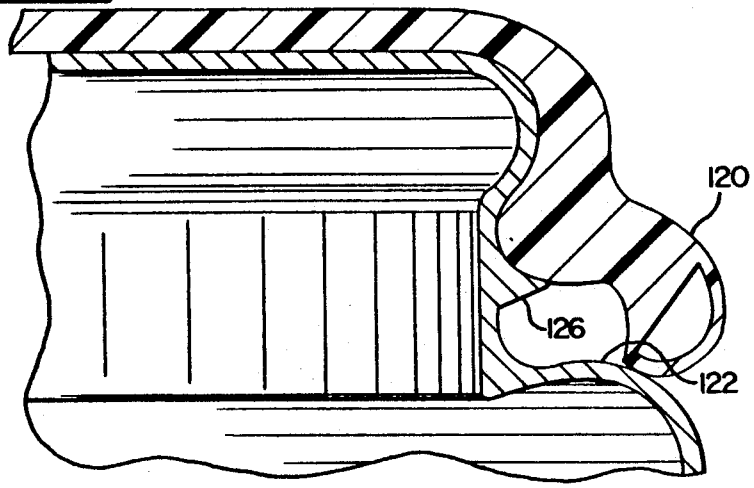
FIG. 8 is a vertical sectional view of another embodiment of the present invention.

The dimensions of the interference bump 88 with respect to the path of travel of the foot 78 are selected to provide the desired operating characteristics. As can be appreciated, different dimensions and arrangements for the interference bumps and foot may be provided to give the hinge different operating characteristics. Referring to FIG. 7, there is depicted a bump 102 that provides a stable open position in which the cover will be open to nearly 180 degrees. Referring to FIG. 8, there is depicted a foot 120, an interference bump 122, and a stop 126, that provides a range of stable open positions.

In the embodiments depicted in both FIGS. 7 and 8, the interference bumps 102, 122 and feet 127 and 120 are constructed as radial shapes that oppose each other. As noted by a comparison of FIGS. 7 and 8, the size of the radii of the bumps and feet can be varied to provide the desired operation characteristics.

As described above with respect to this embodiment, a hollow foot provides the resiliency necessary to traverse the interference bump(s). This resiliency may alternatively be provided by making the interference bump hollow, or by other known means associated with the bump or foot.

It is intended that the foregoing description be regarded as illustrative rather than limiting, and that it be understood that it is the following claims, including all equivalents, which are intended to define the scope of the invention.

I claim:

1. A hinged lid for a container comprising:

a means for attaching the lid to the container, the attaching means having an interior and an exterior, the interior being proximate the contaienr when the attaching means is in place on the container;

a cover connected to the attaching means in a connection area, the cover having an interior and an exterior, the interior being proximate to the container when the cover is closed; and a hinge located in the connction area, the hinge comprising:

a first rib located at the junction of the interior of the cover with the interior of the attaching means, a axis of the rib being parallel to a axis of the inge;

a second rib orthogonal to the first rib, a portion of the second rib being located on the exterior of the cover and a portion of the second rib being located on the exterior of the attaching means.

2. The hinged lid of claim 1 wherein the first rib has a depth dimension at least twice as great as that of the second rib.

3. The hinged lid of claim 1 which is formed as a result of a single molding operation.

4. The hinged lid of claim 3 wherien the hinged lid is molded with the cover in an open position.

5. The hinged lid of claim 1 which is made of polypropylene.

6. The hinged lid of claim 1 wherein the attaching means is a collar.

7. The hinged lid of claim 6 wherein the collar further comprises a foot in the connection area, a portion of the second rib being located on the foot.

8. The hinged lid of claim 7 wherein the foot is formed by two notches, one on either side of the second rib.

9. The hinged lid of claim 8 wherein the first rib has a depth dimension at least twice as great as that of the second rib.

10. The hinged lid of claim 9 which is formed as a result of a single molding operation.

11. The hinged lid of claim 10 which is made of polypropylene.

12. A hinge lid for attaching to a beverage can having a cylindrical side portion with a rim along a cylindrical edge thereof, comprising:

a plastic ring-shaped member positionable around the cylindrical side portion of the can and retainable thereupon by the rim; and a plastic lid portion connected to said plastic ring-shaped member, said plastic lid portion having a circular body portion and a side portion extending from the circular body portion, said side portion having a lip thereupon for engaging the rim of the can.

13. The hinge lid of claim 12 further comprising a radially extending tab connected to said side portion opposite from the connection of said lid portion to said ring-shaped member.

14. The hinge lid of claim 12 inw hich said ring-shaped member and said lid portion are made of a flexible resilient plastic.

* * * * *

UNITED STATES PATENT AND TRADEMARK OFFICE

CERTIFICATE OF CORRECTION

PATENT NO. : 5,078,296
DATED : January 7, 1992
INVENTOR(S) : Amidzich, et al

It is certified that error appears in the above-indentified patent and that said Letters Patent is hereby corrected as shown below:

Col. 7, Claim 1, line 47, delete "connction" and substitute therefor --connection--.

Col. 8, Claim 1, line 2, delete "inge" and substitute therefor --hinge--.

Col. 8, Claim 4, line 12, delete "wherien" and substitute therefor --wherein--.

Col. 8, Claim 12, line 31, delete "hinge" and substitute therefor --hinged--.

Col. 8, Claim 13, line 43, delete "hinge" and substitute therefor --hinged--.

Col. 8, Claim 14, line 46, delete "hinge" and substitute therefor --hinged--.

Col. 8, Claim 14, line 46, delete "inw hich" and substitute therefor --in which--.

UNITED STATES PATENT AND TRADEMARK OFFICE

CERTIFICATE OF CORRECTION

PATENT NO. : 5,078,296

DATED : January 7, 1992

INVENTOR(S) : Amidzich, et al

It is certified that error appears in the above-indentified patent and that said Letters Patent is hereby corrected as shown below:

Column 1, line 52, delete "Theses" and substitute therefor --These--.

Column 3, line 25, after "example" delete ".".

Column 3, line 32, delete "hinqed" and substitute therefor --hinged--.

Column 5, line 34, delete "sinqle" and substitute therefor --single--.

Column 6, line 34, after "similarly" insert --,--.

Column 6, line 50, before "as" delete ".".

IN THE CLAIMS

Column 7, claim 1, line 41, delete "contaienr" and substitute therefor --container--.

Signed and Sealed this

Twenty-sixth Day of July, 1994

Attest:

Bruce Lehman

BRUCE LEHMAN

Attesting Officer

Commissioner of Patents and Trademarks